US005828320A

United States Patent [19]

Buck

[11] Patent Number: 5,828,320

[45] Date of Patent: Oct. 27, 1998

[54] VEHICLE OVERHEIGHT DETECTOR DEVICE AND METHOD

[75] Inventor: John H Buck, Norfolk, Va.

[73] Assignee: Trigg Industries, Inc., Hampton, Va.

[21] Appl. No.: 939,082

[22] Filed: Sep. 26, 1997

[51] Int. Cl.[6] ..... G08G 1/04

[52] U.S. Cl. ..... 340/942; 340/933; 340/436; 340/435; 250/222.1

[58] Field of Search ..... 340/942, 933, 340/436, 555, 556, 435, 425.5; 250/222.1, 221

[56] References Cited

U.S. PATENT DOCUMENTS

| | | | |
|---|---|---|---|
| 923,170 | 6/1909 | Hawkins . | |
| 3,532,886 | 10/1970 | Kruger, Jr. et al. . | |
| 3,675,769 | 7/1972 | Story . | |
| 3,716,833 | 2/1973 | Roth . | |
| 3,896,414 | 7/1975 | Rulo | 340/942 |
| 4,284,971 | 8/1981 | Lowry et al. | 340/942 |
| 4,916,429 | 4/1990 | Hicks . | |
| 5,008,529 | 4/1991 | Nakamura . | |
| 5,066,950 | 11/1991 | Schweitzer et al. . | |
| 5,343,739 | 9/1994 | Curry . | |
| 5,389,912 | 2/1995 | Arvin . | |

*Primary Examiner*—Jeffery A. Hofsass
*Assistant Examiner*—Sihong Huang
*Attorney, Agent, or Firm*—John F. Carroll, IV

[57] ABSTRACT

A dual-beam photoelectric switch and method adapted for detecting overheight vehicles that emits and detects red light along an optical axis, and emits and detects infrared light along a parallel and oppositely oriented optical axis. A fault detector receives signals from the light detectors, processes the signals in accordance with a predetermined logic and produces a pair of outputs indicating the fault status of the light detectors. An alarm mode component receives the signals of light detectors and the fault status outputs, enables and disables recognition of signals of the light detectors in relation to the fault status outputs, and triggers certain outputs in accordance with a predetermined logic.

11 Claims, 10 Drawing Sheets

VEHICLE OVERHEIGHT DETECTOR DEVICE AND METHOD

BACKGROUND

The present invention relates to an improved vehicle overheight detector. The invention is a method and an input/output processing device for: receiving data regarding the presence or absence of an object traveling along a predetermined path, assessing the data received, and outputting information regarding the data in various formats. Specifically, the invention uses one or more optical sensors to detect the presence or absence of a vehicle at a certain height over a road surface, calculate the rate and direction of speed of the vehicle, and provide output regarding this information. The device and method are particularly useful in determining overheight of a vehicle with respect to bridges, tunnels, overpasses and other obstructions. Additionally, the method and device are particularly adapted to reducing the occurrence of false signals attributable to anomalous sources.

Optical switches can be used to detect the presence or absence of objects between a light transmitter and a light receiver. Detecting such objects using an optical switch can be performed by placing the transmitter and receiver in line of sight of each other. An object passing between the transmitter and receiver will block the transmission of light therebetween, thus signaling the presence of the object. Conversely, the reception of light from the transmitter indicates that an object is not between the transmitter and receiver. In practice, however, ambient light and light from anomalous sources can make the data output from such optical switches unreliable.

Of significant importance to the proper operation of such a device is the ability to distinguish between light that is intentionally transmitted and light that is merely incident to the environment in which the device operates. With devices that are intended to operate out-of-doors, common solutions to this problem involve focusing the transmitted light on the receiver and placing the receiver in a long tube to reduce the reception of light from directions other than the light transmitter. Also, light transmitted within narrow spectral boundaries, or monochromatic light transmitted at a frequency that is not commonly found in the environment, can reduce the occurrence of anomalous inputs. Additionally, a light transmitter may emit pulses of light in a predetermined code that can be detected and decoded by the receiver. Anomalous light reception is not likely to occur in the same sequence or rate as coded pulses, thereby reducing the incidence of interference from light sources external to the system. Each of these methods may be used separately or together to increase the likelihood that the data output of the receiver is accurate. However, even by implementing these measures, anomalous source inputs can still effect results. In particular, these safeguards do not prevent direct sunlight that is incident on the receiver from saturating it, causing the device to be unable to detect valid data.

Placement of optical sensing vehicle overheight detectors is often dictated by the direction of the road over which the vehicles travel. Typically, an optical sensor transmitter and receiver are placed on either side of the road, with the line of sight between the sensors at right angles to the direction of vehicle travel over the road. For roads running northerly and southerly, the transmitters and receivers of optical overheight detectors are typically placed in an east-west orientation. Not surprisingly, saturation of light detectors due to sunrise and sunset interference is a common occurrence with such placements. The sensors can be placed at angles other than perpendicular to the vehicle direction of travel. However, this leads only to partial reduction of the saturation problem because the inclination of the Earth on its revolutional axis relative to its rotational axis causes wide swings in the angle of sunrise and sunset from season to season throughout the year.

Many vehicle overheight detectors have been developed. However, there is a need for an optically-based device and method that detects obstructions, reduces inaccurate feedback and provides a redundant backup for adverse environmental conditions.

SUMMARY

A new device and method for detecting vehicle overheight has been invented that is optically-based and that detects obstructions, reduces inaccurate feedback and provides a redundant backup for adverse environmental conditions. The device is a dual-beam type photoelectric switching device with a first transmitter for emitting red light in a first direction along a first optical axis. A first detector is placed along the first optical axis, receives red light emitted from the first transmitter and outputs a signal indicating the presence and absence of red light. The device has a second transmitter for emitting infrared light in a second direction along a second optical axis. A second detector is placed along the second optical axis, receives infrared light emitted from the second transmitter and outputs a signal indicating the presence and absence of infrared light. The first optical axis and the second optical axis are approximately parallel to each other and the first direction and the second direction are approximately opposite of each other. In addition, the device has a fault detector for receiving the signal from the light detectors, processing these signals and producing a pair of outputs indicating the fault status of the light detectors. The device has an alarm mode component for receiving the signal of the light detectors and the fault status outputs. This alarm mode component enables and disables recognition of signals of the light detectors in relation to the fault status outputs and triggers certain outputs regarding fault status, vehicle overheight and direction of travel of overheight vehicles in accordance with a predetermined logic.

A method of the invention for detecting an object using a dual-beam type photoelectric switching device has the step of emitting red light from a first transmitter in a first direction along a first optical axis, receiving red light emitted from the first transmitter by a first detector placed along the first optical axis, and outputting a signal with the first detector to indicate the presence and absence of red light. The method has the step of emitting infrared light from a second transmitter in a direction opposite to the first direction along an optical axis parallel to the first, receiving infrared light emitted from the second transmitter by a second detector placed along the second optical axis, and outputting a signal with the second detector to indicate the presence and absence of red light. The method also has the step of receiving the signals of the light detectors with a fault detector, processing said signals and producing a pair of outputs indicating the fault status of said light detectors. Additionally, the method has the step of receiving the signals of the detectors and the fault signals, enabling and disabling recognition of signals of the light detectors in relation to the fault status outputs, and triggering certain outputs regarding fault status, vehicle overheight and the direction of travel of overheight vehicles in accordance with a predetermined logic.

BRIEF DESCRIPTION OF THE DRAWINGS

A preferred embodiment of the present invention will be described in greater detail with reference to the accompanying drawings, wherein like elements bear like reference numerals and where.

DESCRIPTION

A. Signal Input and Conditioning

Figure 1:
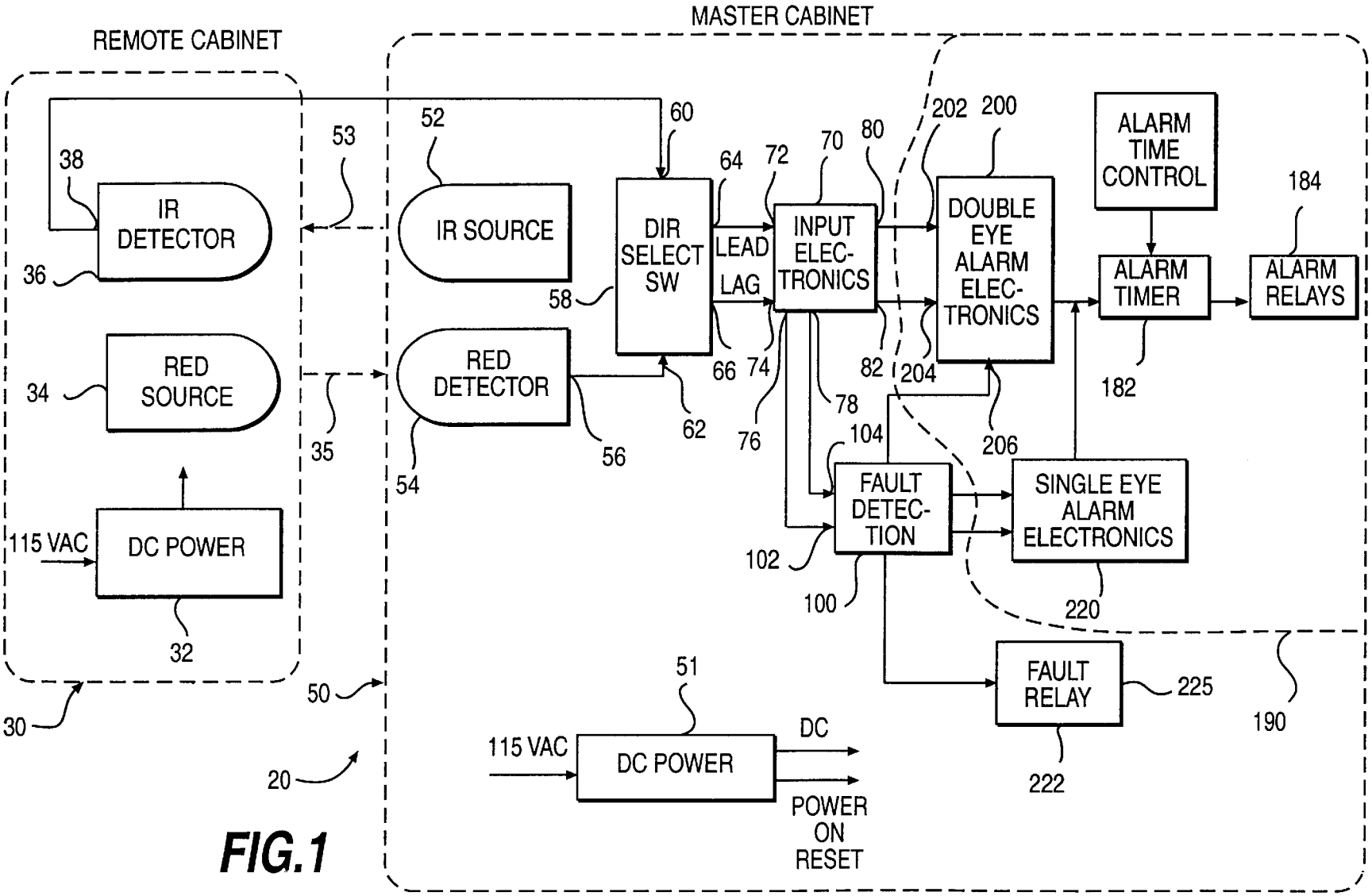
FIG. 1 is a diagram showing a construction of an optical, dual-beam type vehicle overheight detector according to an embodiment of the present invention.
Figure 2:
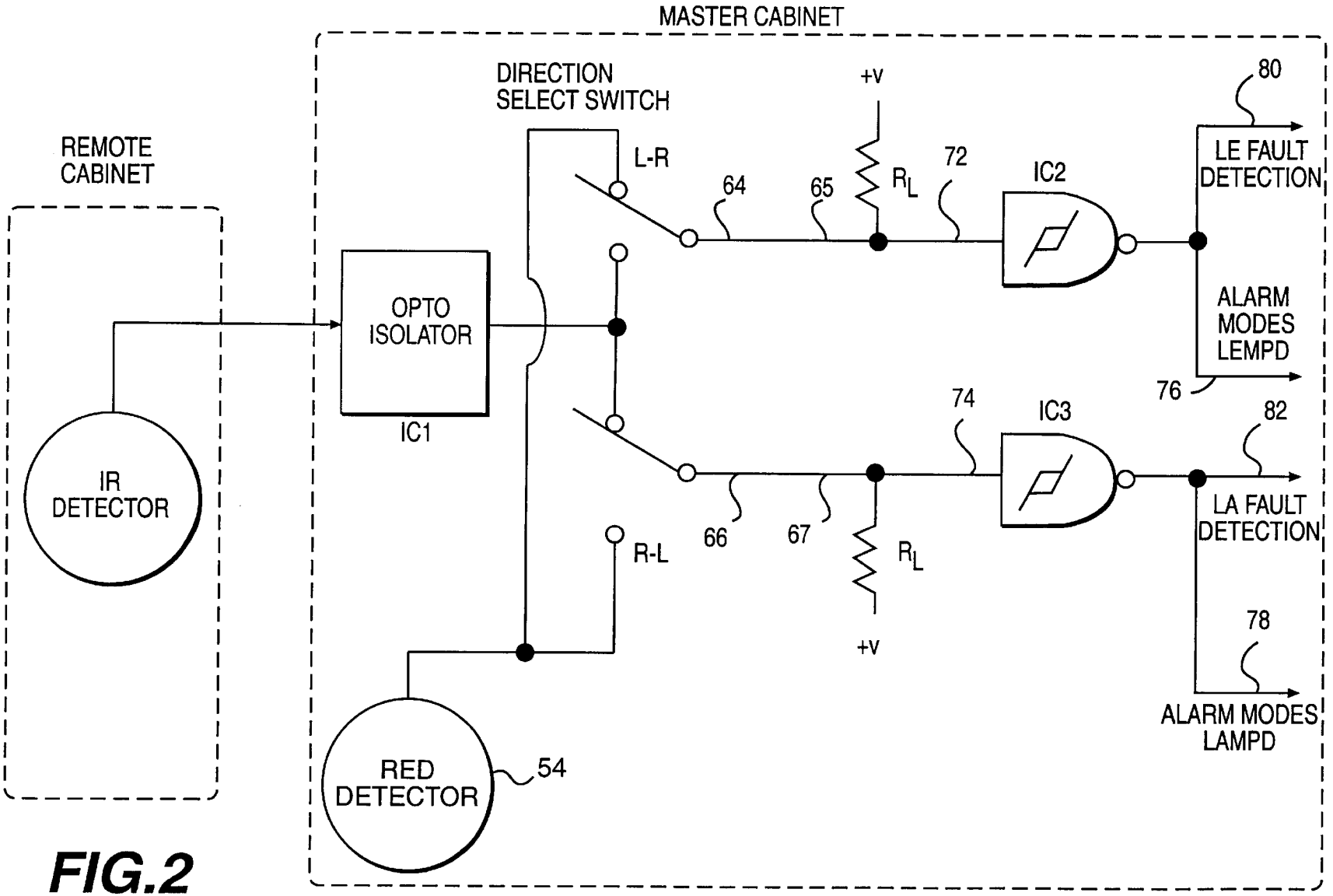
FIG. 2 is a diagram showing a partial schematic for direction discernment according to an embodiment of the present invention.
Figure 5:
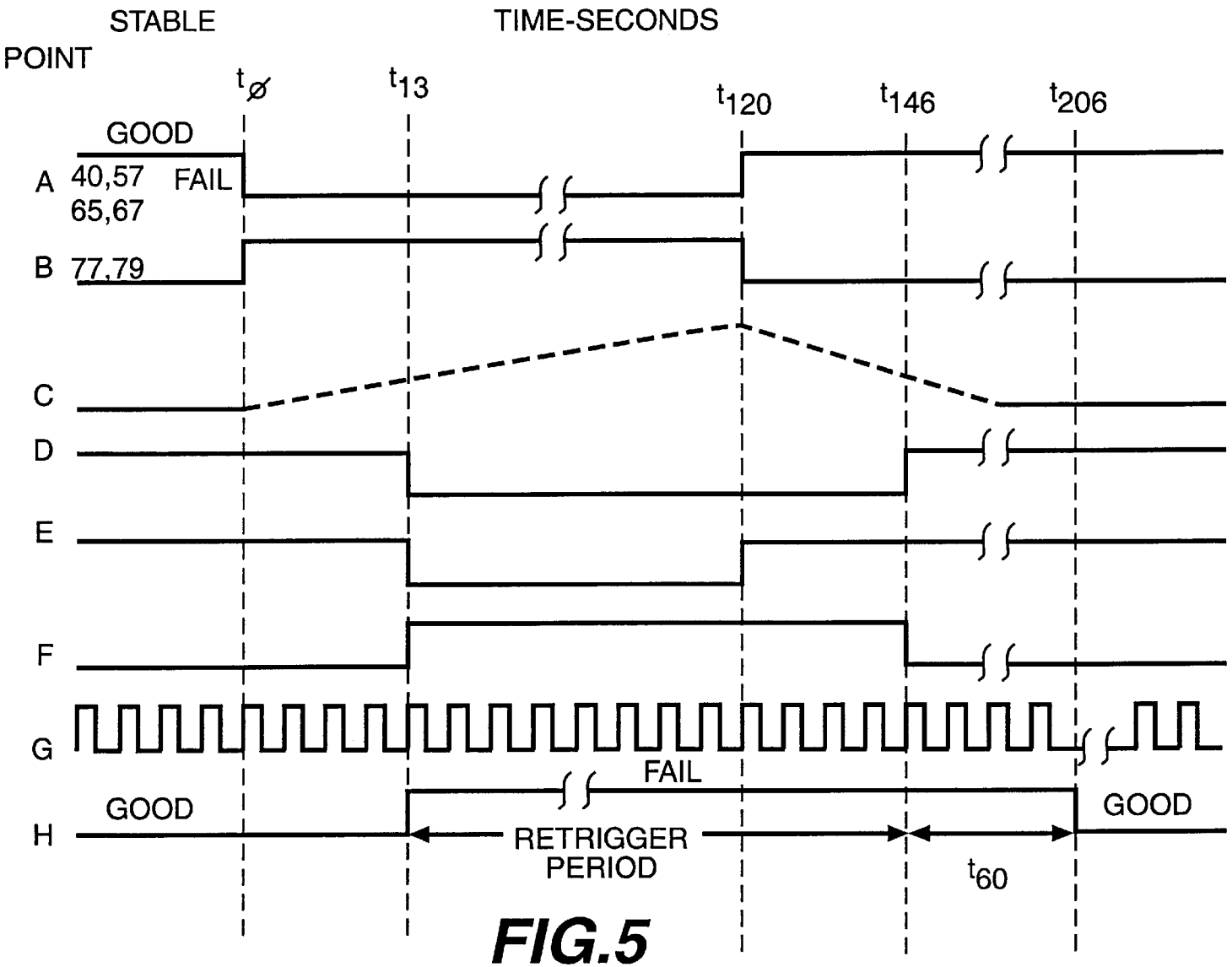
FIG. 5 is a timing diagram for fault detection at the points indicated in FIGS. 3 and 4.

With reference next to the drawings, FIG. 1 shows a device 20 that can be adapted for detecting vehicle overheight. For convenience of packaging components, the device 20 has a master cabinet 50 and a remote cabinet 30. The master cabinet 50 houses a direct current power source 51 which is in electrical connection with components of the master cabinet 50, including an infrared light source 52 capable of emitting an infrared light signal 53 and a red light detector 54. The control of the infrared light source 52 will be described herein. The red light detector 54 has an output terminal 56 that is electrically connected to a direction selector switch 58 as described herein. As shown in FIG. 5, the output terminal 56 of the red light detector 54 carries a signal 57 from the red light detector 54. Components of the remote cabinet 30 are in electrical connection with the master cabinet 50. Additionally, the remote cabinet 30 is in optical line of sight with the master cabinet 50. The remote cabinet 30 houses a direct current power source 32 which is in electrical connection with the components of the remote cabinet 30, including a red light source 34 and an infrared light detector 36. The red light source 34 is capable of emitting a red light signal 35. The infrared light detector 36 is in optical line of sight with the infrared light source 52. The red light source 34 is in optical line of sight with the red light detector 54. The line of sight between the red light source 34 and the red light detector 54 and the line of sight between the infrared light source 52 and the infrared detector 36 are approximately parallel to each other, and in a horizontal plane. The plane formed by the lines of sight is also approximately parallel with the road surface. The infrared light detector 36 has an output terminal 38 that carries a signal 40. This infrared light detector output terminal 38 is in electrical connection with the direction selector switch 58 of the master cabinet 50 as described herein.

The direction selector switch 58 has a first input terminal 60 in electrical connection with the output terminal 38 of the infrared light detector 36. The direction selector switch 58 also has a second input terminal 62 in electrical connection with the output terminal 56 of the red light detector 54. The direction selector switch 58 has a first output terminal 64, also called a lead output terminal, that carries an unconditioned lead signal 65 and a second output terminal 66, also called a lag output terminal, that carries an unconditioned lag signal 67. The direction selector switch 58 is set depending on the direction of vehicle traffic flow as follows. If oncoming traffic would typically first strike a beam traveling on the line of sight between the red light source 34 and the red light detector 54, then the direction selector switch 58 is set so that the unconditioned lead signal 65 carried by the lead output terminal 64 of the direction selector switch 58 is related to the signal 57 of the output terminal 56 of the red light detector 54 and the unconditioned lag signal 67 carried by the lag output terminal 66 of the direction selector switch 58 is related to the signal 40 of the output terminal 38 of the infrared light detector 36. If oncoming traffic would typically first strike a beam traveling on the line of sight between the infrared light source 52 and the infrared light detector 36, then the direction selector switch 58 is set so that the lead signal 65 carried by the lead output terminal 64 of the direction selector switch 58 is related to the signal 40 of the output terminal 38 of the infrared light detector 36 and the lag signal 67 carried by the lag output terminal 66 of the direction selector switch 58 is related to the signal 57 of the output terminal 56 of the red light detector 54.

Preferably, the infrared light source 52 and the infrared light detector 36 should have a detection capability of about one millisecond (1 ms). The infrared light source 52 can be similar to infrared light source model number SMA30SELMHS and the infrared light detector 36 can be similar to infrared light detector model number SM30SRLMHS both as manufactured by Banner Engineering of Minneapolis, Minn. Preferably, the red light source 34 and the red light detector 54 should have the detection capability of about one millisecond (1 ms). The red light source 34 can be similar to red light source model number E58-30TS250-HA and the red light detector 54 can be similar to red light detector model number E58-30TD250-HD, both as manufactured by Cutler-Hammer of Everett, Wash.

If the red light detector 54 detects the red light signal 35 as emitted from the red light source 34, the red light detector 54 transmits a signal 57 through the red light detector output terminal 56. If the red light detector 54 fails to detect the red light signal 35 as emitted from the red light source 34, the red light detector 54 transmits a different signal 57 through the red light detector output terminal 56. If the infrared light detector 36 detects the infrared light signal 53 as emitted from the infrared light source 52, the infrared light detector 36 transmits a signal 40 through the infrared light detector output terminal 38. If the infrared light detector 36 fails to detect the infrared light signal 53 as emitted from the infrared light source 52, the infrared light detector 36 transmits a different signal 40 through the infrared light detector output terminal 38. The signal 57 of the red light detector 54 and the signal 40 of the infrared light detector 36 can be analog or digital.

For example, the signal 57 of the red light detector 54 can be a low voltage when the red light signal 35 is not detected by the red light detector 54 and a high voltage when the red light signal 35 is detected by the red light detector 54. The signal 40 of the infrared light detector 36 can be a low voltage when the infrared light signal 53 is not detected by the infrared light detector 36 and a high voltage when the infrared light signal 53 is detected by the infrared light detector 36. In the embodiment described herein, preferably the low voltage signal 57 of the red light detector 54 is approximately one to two volts direct current (1–2 VDC) and the high voltage signal 57 of the red light detector 54 is approximately eight to eleven volts direct current (8–11 VDC). Also, the low voltage signal 40 of the infrared light detector 36 is approximately one to two volts direct current (1–2 VDC) and the high voltage signal 40 of the infrared light detector 36 is approximately eight to eleven volts direct current (8–11 VDC). If the red light signal 35 is not able to be interpreted, e.g., by either blockage of the signal 35 or saturation of the detector 54 by other red light sources, the signal 57 of the output terminal 56 of the red light detector 54 drops from the high voltage to the low voltage during the blockage or anomaly. If the infrared light signal 53 is not able to be interpreted, e.g., by either blockage of the signal 53 or saturation of the detector 36 by other infrared light sources, the output terminal 38 of the infrared light detector 36 drops from the high voltage to the low voltage. A fast moving truck with a small diameter obstruction that momentarily interrupts the transmission and detection of a light signal 53, 35 will cause a pulse at the output terminal 38,56 of the detector 36, 54 equal in duration to the time that the signal 53, 35 is blocked. A truck with a large obstruction that stops and blocked the transmitted signal 53, 35 will cause a continuous low voltage at the output terminal 38, 56 of the associated detector 36, 54 during the blockage.

As described herein, the direction selector switch 58 is positioned so that the lead output terminal 64 and the lag output terminal 66 of the direction selector switch 58 are appropriately matched with the direction of travel of the applicable vehicle traffic through the red light signal 35 and the infrared light signal 53. Whichever source-signal-detector combination (whether that be: (a) the red light source 34, the red light signal 35 and the red light detector 54, or (b) the infrared light source 52, the infrared light signal 53 and the infrared light detector 36) that is associated with the lead output terminal 64 and its related unconditioned signal 65 of the direction selector switch 58, may herein be referred to as lead light source 41, lead light signal 42 and lead light detector 43, respectively. Whichever source-signal-detector combination (whether that be: (a) the red light source 34, the red light signal 35 and the red light detector 54, or (b) the infrared light source 52, the infrared light signal 53 and the infrared light detector 36) that is associated with the lag output terminal 66 and its related unconditioned signal 67 of the direction selector switch 58 may herein be referred to as lag light source 44, lag light signal 45 and lag light detector 46, respectively.

The lead output terminal 64 and the lag output terminal 66 are in electrical connection with an input electronics component 70 as described herein. The input electronics component 70 has a first input terminal 72 and a second input terminal 74. The input electronic component 70 acts as a signal conditioner, reducing noise generated by the preceding elements in the system by acquiring signals and retransmitting facsimiles of these signals with reduced noise levels. The input electronics component 70 has: a first output terminal 76 to transmit a conditioned lead signal 77 that is related, as described herein, to the unconditioned signal 65 of the lead output terminal 64 of the direction selector switch 58 as said signal 65 has been conditioned by the input electronics component 70; and a second output terminal 78 to transmit a conditioned lag signal 79 that is related, as described herein, to the unconditioned signal 67 of the lag output terminal 66 of the direction selector switch 58 as it has been conditioned by the input electronics component 70. The input electronics component 70 also has a third output terminal 80 for carrying the conditioned lead signal 77 and a fourth output terminal 82 for carrying the conditioned lag signal 79.

The lead output terminal 64 of the direction selector switch 58 is in electrical connection with the first input terminal 72 of the input electronics component 70, and the lag output terminal 66 of the direction selector switch 58 is in electrical connection with the second input terminal 74 of the input electronics component 70. The input electronics component 70 can be a digital or analog signal processor. The input electronics component 70 conditions signals it receives by acting as a triggering device. The first input terminal 72 of the input electronics device 70 receives the unconditioned lead signal 65 from the direction selector switch 58. If the unconditioned lead signal 65 is above a certain threshold value, the input electronics component 70 will transmit a logically low lead output signal 77 output related to the lead input signal 65. If the lead signal 65 is below a certain threshold value, the input electronics component 70 will transmit a logically high lead output signal 77 related to the lead input signal 65. Similarly, the second input terminal 74 of the input electronics device 70 receives the unconditioned lag signal 67 from the direction selector switch 58. If the lag signal 67 is above a certain threshold value, the input electronics component 70 will transmit a logically low lag output signal 79 related to the lag input signal 67. If the lag signal 67 is below a certain threshold value, the input electronics component 70 will transmit a logically high lag output signal 79 related to the lag input signal 65. Preferably, the input electronics component 70 can use CMOS Schmitt-type triggers with a threshold of some moderately low voltage, such as about two (2) volts, DC. Such a selection provides high noise immunity for the photodetector eye output signals 40, 57.

B. Fault Detection

The input electronics component 70 is in electrical connection with a fault detection component 100. The fault detection component 100 has a first input terminal 102 and a second input terminal 104. The lead output terminal 76 of the input electronics component 70 is in electrical connection with the first, or lead, input terminal 102 of the fault detection component 100, for transmitting the lead signal 77 of the input electronics component 70 to the fault detection component 100. The lag output terminal 78 of the input electronics component 70 is in electrical connection with the second, or lag, input terminal 104 of the fault detection component 100 for transmitting the lag signal 79 of the input electronics component 70 to the fault detection component 100.

1. Fault Detection Overview

In the preferred embodiment, the fault detection component 100 performs several signal assessments and processes based upon the data from the conditioned lead and lag signals 77, 79 of the input electronics component 70, including the following shown in Table 1:

TABLE 1

Fault Detection

| No. | Lead Signal | Lag Signal | Assessment | Action |
|---|---|---|---|---|
| 1 | Low | Low | Normal operation | No fault action |
| 2 | Low | High for more than $X_1$ seconds | Lag Light Detector unable to properly read Lag Light Signal due to environmental conditions or detector failure | Switch to Single Signal Mode using Lead Light Signal; Restore system to Double Eye Mode $X_2$ seconds following restoration of failed signal for at least $X_3$ seconds |
| 3 | High for more than $X_1$ seconds | Low | Lead Light Detector unable to properly read Lead Light Signal due to environmental conditions or detector failure | Switch to Single Signal Mode using Lag Light Signal; Restore system to Double Eye Mode $X_2$ seconds following restoration of failed signal for at least $X_3$ seconds |

Event 1 is the normal operating status of the device 20 with both the red light detector 54 properly detecting the signal 35 of the red light source 34 and the infrared light detector 36 properly detecting the signal 53 of the infrared light source 52.

Events 2 and 3 occur when either the lead detector 43 or the lag detector 46, for at least a certain period of time, $X_1$, is blocked, saturated, or otherwise not properly reading the signal 42, 45 of either the lead source 41 or the lag source 44. The detector 43, 46 experiencing the fault is known herein as the faulted detector 120. The signal 42, 45 associated with the faulted detector 120 is known as the faulted signal 118. The light source 41, 44 associated with the faulted detector 120 is known as the faulted source 116. The detector 43, 46 that is not experiencing the fault is known herein as the good detector 114. The signal 42, 45 associated with the good detector 114 is known as the good signal 112. The light source 41, 44 associated with the good detector 114 is known as the good source 110.

In an Event 2 or 3 situation, the fault detection component 100 acts to switch the device 20 from Double Eye Mode to Single Signal Mode, as described herein, and issue a Single Eye Fault Alarm indicating that the device has switched to Single Eye Mode. The period of time, denoted $X_1$ in the chart above, is a period of time adequate to prevent a phenomenon known as "chatter" or "jitter", or rapid switching of the device from Double Eye Mode to Single Eye Mode due to a brief fault in the detector 43, 46 reading the signal 42, 45 of the source 41, 44. The $X_1$ period of time can range from instantaneous to more than several minutes. Preferably, however, the $X_1$ period of time is from about five (5) seconds to about fifteen (15) seconds, depending on environmental conditions. Most preferably, the $X_1$ period of time is about thirteen (13) seconds. Following switching of the device 20 from Double Eye Mode to Single Eye Mode, the fault detection component 100 monitors the status of the faulted signal 118, as conditioned by the input electronics component 70. Following restoration of the faulted signal 118 for a period of $X_3$ seconds, the fault detection component 100 cycles through a delay of $X_2$ seconds before switching the device 20 from Single Eye Mode to Double Eye Mode. The delay incurred before switching the device 20 back to Double Eye Mode reduces chatter. The $X_3$ period of time can range from instantaneous to more than several minutes. Preferably, the $X_3$ period of time ranges from approximately ten (10) seconds to about thirty (30) seconds. Most preferably, the $X_3$ period of time is approximately double that of $X_1$, or approximately twenty-six (26) seconds. Preferably the $X_2$ period of time is from about thirty (30) seconds to about three hundred (300) seconds, or five (5) minutes, depending on environmental conditions. Most preferably, the $X_2$ period of time is about sixty (60) seconds.

The benefit of Double Eye Mode is that the system provides direction discernment and will automatically segregate inputs that indicate improper vehicular direction of travel (i.e., away from the obstruction) from those that are relevant. Overheight vehicles traveling away from the direction of interest can be ignored or a separate alarm can be provided regarding them. Data inputs regarding improbable occurrences are also ignored in Double Eye Mode. The device 20 can be set so that inputs indicating vehicle speeds of less than a very slow speed, such as about 0.5 miles per hour, and more than a very high speed, such as about 75 miles per hour to 95 miles per hour, are ignored. Additionally, as an error reducing feature in Double Eye Mode, the obstruction should be at least large enough to block both the red light signal 35 and the infrared light signal 53 completely, preferably approximately two (2) inches in width and one (1) inch above the height of detection for a vehicle traveling within the above defined range of speeds.

2. Fault Detection Operation

In practice, the device 20 enters Single Eye Mode when one of the source-detector combinations 34–54, 52–36 produces anomalous data for a certain amount of time and is temporarily disabled, as described herein. In Single Eye Mode the device 20 provides no direction discernment. There is also no minimum limitation on the speed of the obstruction. When the device 20 enters Single Eye Mode, a Single Eye Mode Fault Alarm may be issued coincident with an overheight vehicle detection.

Figure 3:
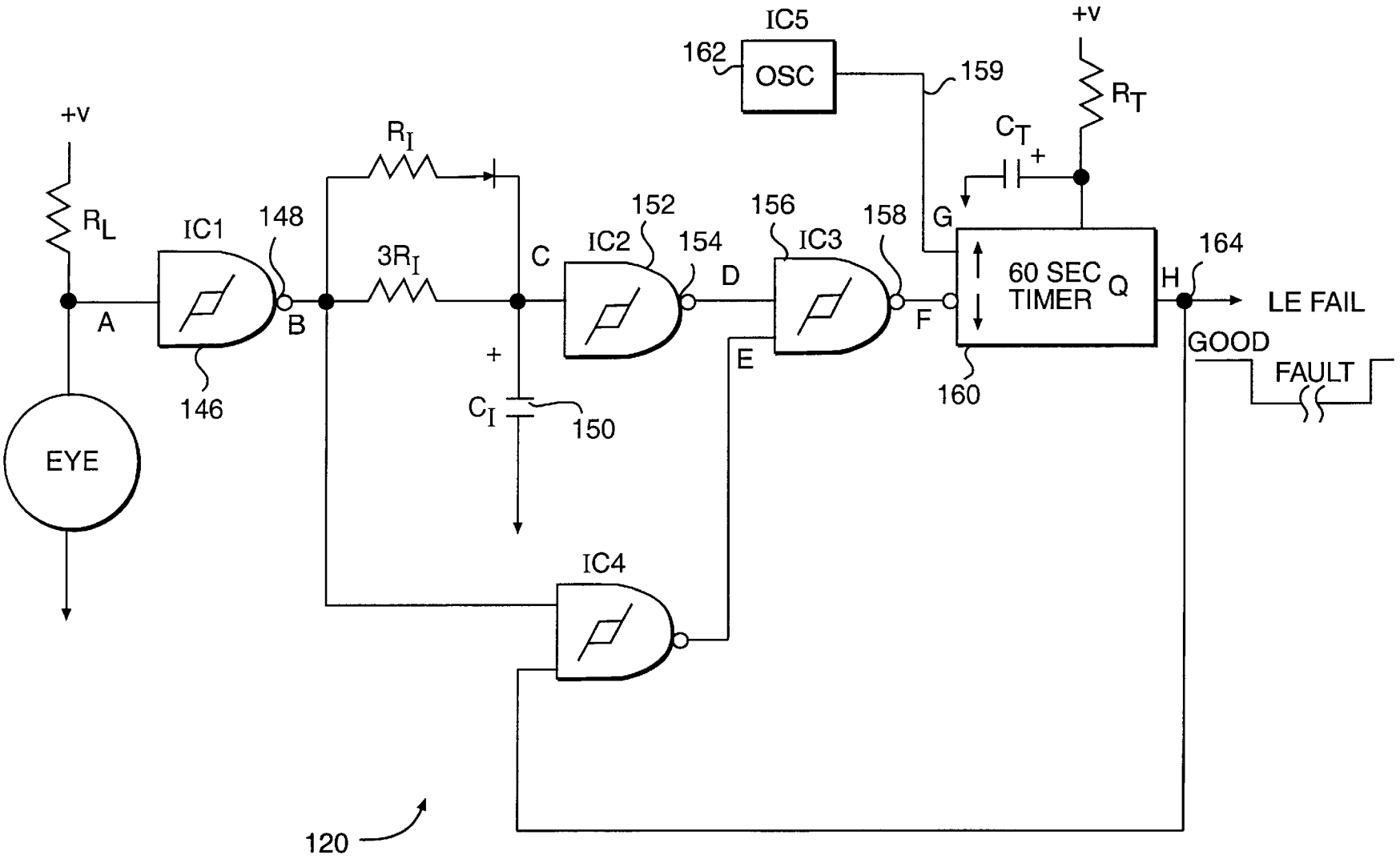
FIG. 3 is a diagram showing a partial schematic for fault detection related to the light signal of the master cabinet according to an embodiment of the present invention.
Figure 4:
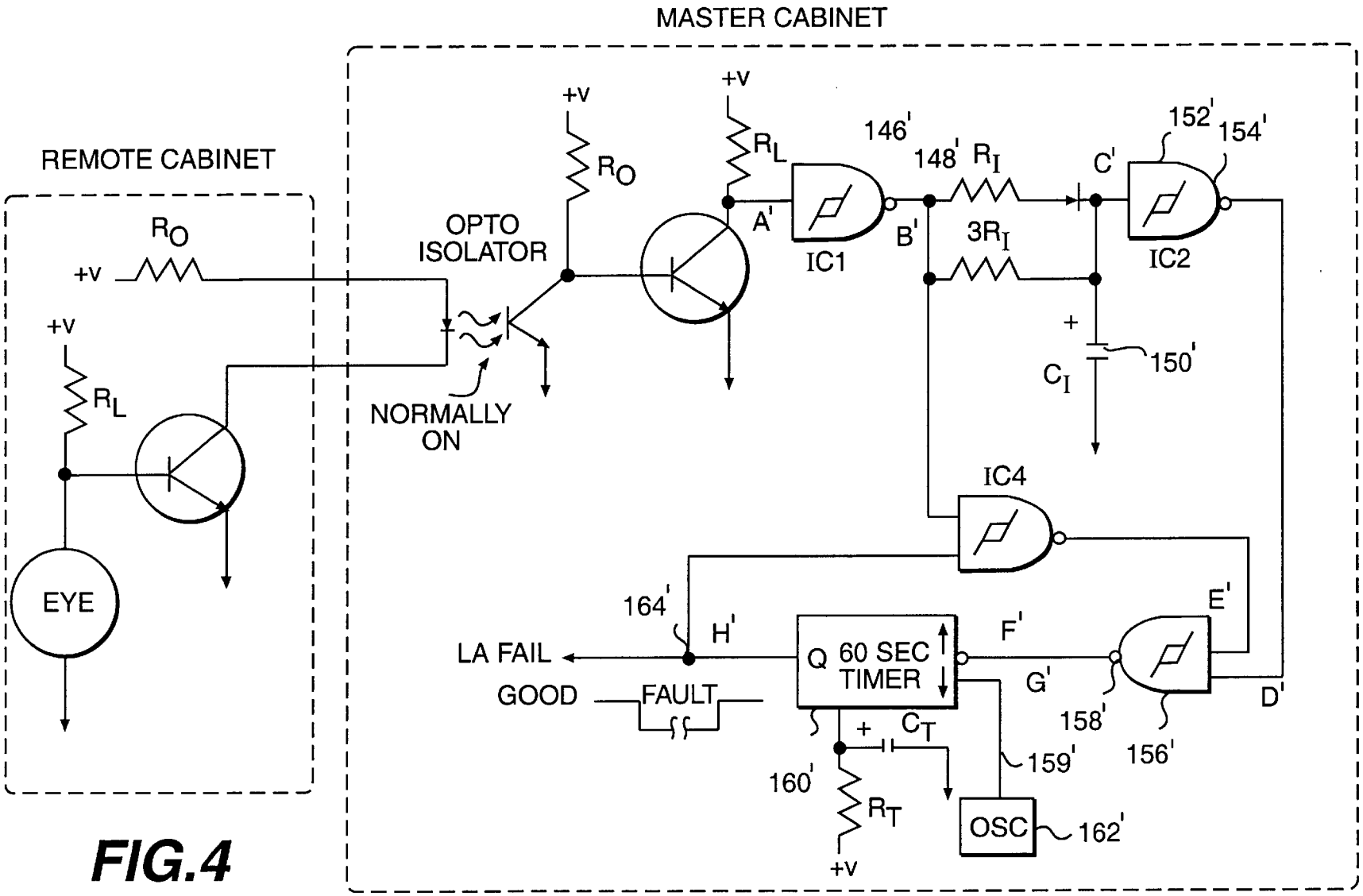
FIG. 4 is a diagram showing a partial schematic for fault detection related to the light signal of the remote cabinet according to an embodiment of the present invention.

With reference to FIGS. 2–6, the following is an overview of a preferred mode of fault detection in the device 20. With the device 20 in normal, Event 1, operation, with no detector 36, 54 blocked or receiving anomalous inputs, the logic levels of the system are shown in FIG. 5 under the Stable column. As seen in FIGS. 3 and 4, since fault detection is essentially identical for signals 40, 57 generated by the detectors 36, 54, only fault detection for the light detector 54 located in the master cabinet 50 will be discussed. Since the components and process for fault detection in an Event 2 or Event 3 situation are virtually identical, similar components shown in FIG. 4 will be denoted herein with similar numbers as shown in FIG. 3, and those components associated with signals generated by the detector 36 in the remote cabinet 30 will also be denoted with a "'" symbol (e.g., 162').

If an Event 2 or 3 situation were to occur, assume that the signal 57 of the red light detector 54, shown in FIGS. 3 and 5 at point A and time to, would go low. A first logic device 146, with an output terminal 148, can be in electrical connection with the first lead input terminal 102 of the fault detection component 100. Upon reception of a signal 77, 79 related to the signal 57 of the red light detector 54 that is logically low, the first logic device 146 produces a signal at its output terminal 148 that is logically high, with a relative amount as shown at point B and time $t_0$ in FIG. 5. This causes an integrating capacitor 150 in electrical connection with the output terminal 148 of the first logic device 146 to begin charging, as shown at point C and time $t_0$ in FIG. 5. The integrating capacitor 150 has a discharge rate which can be twice its charge rate, which reduces chatter, and is connected to a second logical device 152. The second logical device 152 has an output terminal 154 that carries a logically low signal, as shown at point D in FIG. 5, when the integrating capacitor 150 has been charging for a certain amount of time, $X_1$. This constant, $X_1$ is preferably set for approximately 13±3 seconds. A low level signal produced at the output terminal 154 of the second logical device 152 causes an attached third logical device 156 to produce a logically high signal at its output terminal 158, shown at point F in FIG. 5, at time $t_{13}$. This causes an attached timer 160, with an output terminal 164, to begin timing, and a logically high signal to be produced at the output terminal 164 of the timer 160. However, an oscillator 162, which is also attached to the timer 158 causes the timer to be retriggered and not time out. The signal produced at the output terminal 164 of the timer 160 is also known as LEFAIL for outputs associated with the lead light detector 43 and LAFAIL for outputs associated with the lag light detector 46.

As discussed herein, the timer 160 is set at a predetermined period of time, $X_2$, to limit chatter in switching between Single Eye Mode and Double Eye Mode. This period of time is preferably approximately sixty (60) seconds. Assuming the detector 54 located in the master cabinet 50 were to recover at some time, $T_r$, and remain in normal, unobstructed operation, the integrating capacitor 150 will discharge and at the input switching point, at a time of $X_3$, the output terminal 154 of the second logical device 152 will return to a high level. At this time the signal associated with the output terminal 158 of the third logic device 156, shown at point F of FIG. 5 and time, $t_{146}$, returns to its stable state, which disables the oscillator 162 and allows the timer 160 to complete its cycle of $X_2$seconds. This causes the output of the timer to remain high through the end of the cycle of the timer 160. Using FIG. 5 as an example, if the detector 54 of the master cabinet 50 were to fail at time to and recover at time $t_{120}$, the system would switch to Single Eye Mode at time $t_{13}$ and return to Double Eye Mode at time $t_{206}$.

C. Alarm Mode

1. Alarm Mode Overview

Figure 6:
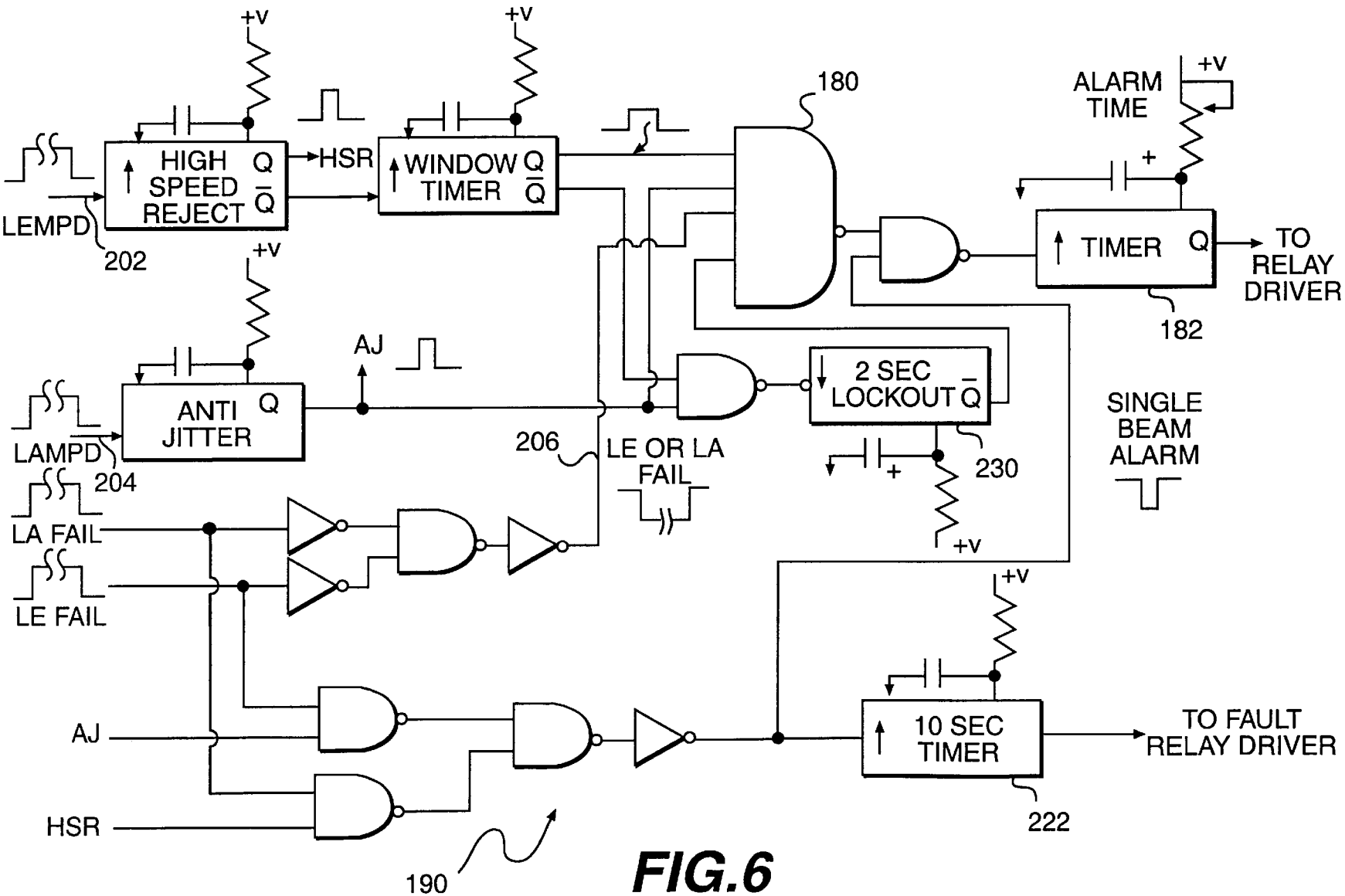
FIG. 6 is a diagram showing a partial schematic for alarm modes according to an embodiment of the present invention.

As shown in FIGS. 5 and 6, the device 20 has an alarm mode component 190, which is comprised of double eye alarm electronics 200 and single eye alarm electronics 220. The alarm mode component 190 performs several signal assessments and processes based upon the data from the LEFAIL and LAFAIL signals of the timer output terminal 164, 164' of the fault detection component 100, as well as the conditioned lead and lag signals 77, 79 of the third 80 and fourth 82 output terminals of the input electronics component 70, including the following shown in Table 2:

TABLE 2

| | | | Alarm Modes | | | |
|---|---|---|---|---|---|---|
| No | LEMPD | LAMPD | LEFAIL | LAFAIL | Assessment | Action |
| 2 | High | Failed | Low | High | Lag Light Detector failed | Issue Single Eye Fault Alarm; issue Overheight Alarm if LEMPD goes high |
| 3 | Failed | High | High | Low | Lead Light Detector failed | Issue Single Eye Fault Alarm; issue Overheight Alarm if LAMPD goes high |
| 4 | Low | Low at t seconds of LEMPD going low so long as $Y_1 < t < Y_2$ | Low | Low | Overheight Obstruction | Issue Overheight Alarm |
| 5 | High | Low | Low | Low | Overheight Vehicle travelling wrong way on roadway | Issue Wrong Way Alarm and/or lockout |

Switching from Double Eye Mode to Single Eye Mode, as described herein as Events 2 and 3, causes the alarm mode component 190 to issue a Single Eye Mode Alarm. If this Alarm is an audible alarm, preferably it is short in duration, for example approximately ten (10) seconds, and is deactivatable. While the device 20 is in Single Eye Mode, any obstruction that causes either LEMPD or LAMPD to go high, whichever is active, thereby indicating the presence of an overheight object, causes an Overheight Alarm to be issued.

Event 4 is the condition that arises when an overheight vehicle passes through and blocks transmission of both the lead signal 42 and the lag signal 45. To reduce anomalous environmental occurrences, such as a passing flock of birds, from interfering with the operation of the device 20, the lead signal 42 must first be blocked, and then the lag signal 45 must be blocked before the alarm mode component 190 will trigger an Overheight Alarm. The blockage of the lag signal 45 must occur following $Y_1$ seconds of the first blockage of the lead signal 42, but not more than $Y_2$ seconds following blockage of the lead signal 42 for an Event 4 Overheight Alarm to be triggered.

As described herein, the red light source 34 and its associated red light detector 54 transmit and receive a light signal 35 that travels on a path that is approximately parallel to the signal 53 that is transmitted and received by the infrared source 52 and its associated detector 36. The parallel paths of the two signals 35, 53 define a plane. As discussed herein, the plane defined by the paths of the signals 35, 53 is approximately parallel to the roadway over which the signals 35, 53 travel. The red source 34 is placed adjacent to the infrared detector 36 and the infrared source 52 is placed adjacent to the red detector 54. The distance of travel in the direction of the roadway, $D_1$, between the red source 34 and the infrared detector 36 is approximately the same as the distance in the direction of travel of the roadway, $D_2$, between the infrared source 52 and the red detector 54.

Because the distance between the sources and detectors, either $D_1$ or $D_2$, is readily ascertainable, a time, $t_{elapsed}$, elapsing between the lead signal 65 going low and the lag signal 67 subsequently going low can be used to calculate the speed, s, of the obstruction blocking the signals by using the relationship $s=(D_{1\ or\ 2})(t_{elapsed})$. This relationship can be used to reduce the chances of anomalous inputs from skewing Event 4 results. The alarm mode component 190 can be set to produce an Overheight Alarm when an obstruction blocks the lead signal 42 and the lag signal 45 within a predefined range of time the correspond to a range of overheight vehicle speeds that are commonly expected. $Y_2$ can be a length of time related to approximately one half miles per hour (0.5 mph) or less of speed of travel of the potential obstruction and $Y_1$ can be a length of time related to approximately seventy miles per hour (70 mph) or more of speed of travel of the potential obstruction. Preferably, $Y_2$ is a time related to approximately one (1) mile per hour of obstruction speed and $Y_1$ is a length of time related to approximately seventy-five (75) miles per hour of obstruction speed.

Event 5 is triggered by a vehicle with an obstruction travelling the wrong way past the device 20. The operation of the device 20 is much the same as in Event 4, except that the lag light signal 45 is interrupted before the lead light signal 42. When this occurs the Overheight Alarm is disabled, and instead, a Wrong Way Alarm or other input noise reducing capability, such as an Overheight Alarm Lockout, can be triggered.

Based upon the description provided herein, it can be assessed that in the event of a power failure in the remote cabinet 30, the red light source 34 is extinguished and the infrared light detector 36 produces no signal 40 at its output terminal 38. The red light detector 54 produces a low signal 57 at its output terminal 56. If this dual fault condition persists for more than $X_1$ seconds, then the fault detection component 100 causes the fault relay 222 shown in FIG. 1 to de-energize, indicating a System Fault. The normally closed contacts of fault relay 222 may be connected to an external device such as a computer interface whereby the computer system detects this contact closure and via software, alerts an operator either visually or aurally of the System Fault.

2. Alarm Mode Operation

Figure 7:
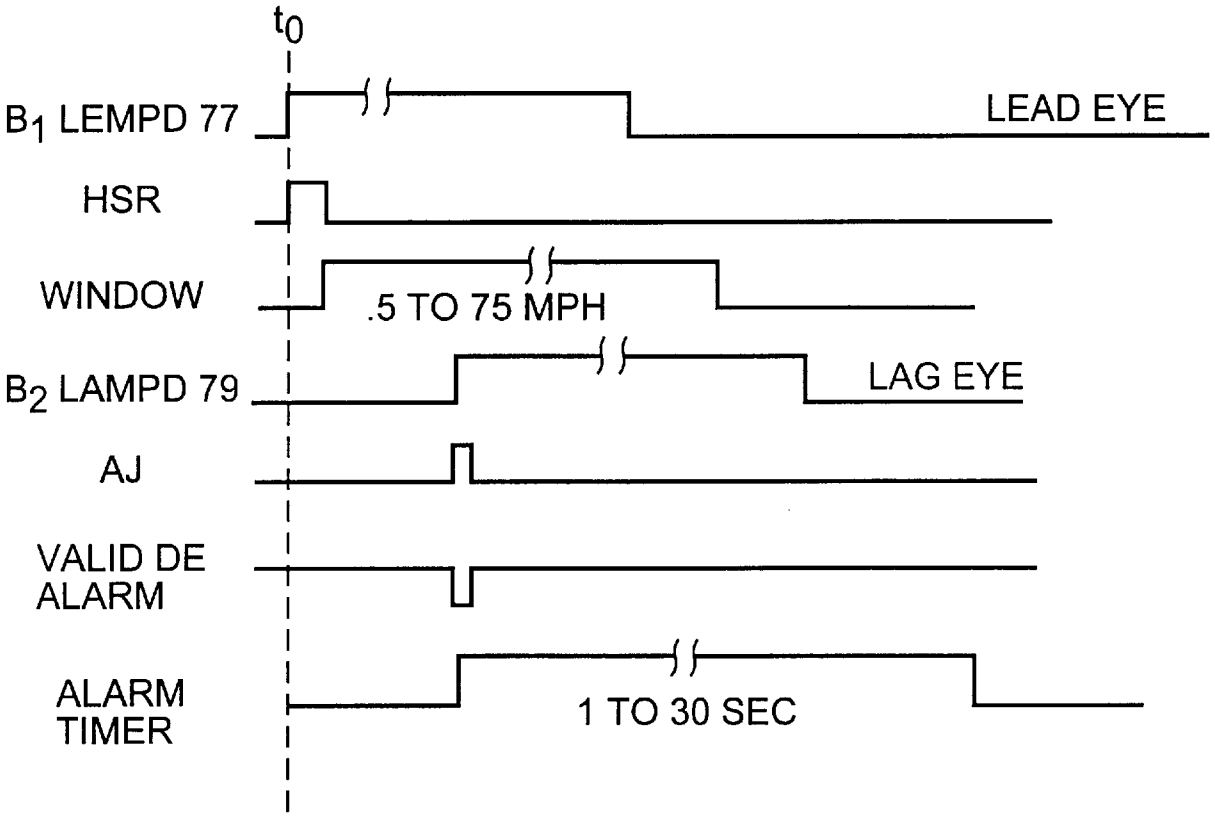
FIG. 7 is a timing diagram for dual-source alarm timing at points indicated in FIG. 6.

In operation, with reference to FIG. 6 and FIG. 7, the following events generate an Event 4 overheight vehicle alarm. The direction selector switch 58 is set appropriately for the direction of vehicular travel relative to the device 20 as described herein. An overheight vehicle approaches the device 20 in the appropriate direction, interrupting the lead light signal 42 and then the vehicle blocks the lag light signal 45. The blocking of the lead light signal 42 causes a logically high conditioned lead eye signal (LEMPD) to be generated as discussed herein at the third output terminal 80 of the input electronics component 70, which output terminal 80 coincides with the first output terminal 76 of the input electronics component 70, the relative level of the LEMPD being shown at $B_1$ in FIG. 7.

In addition to the components as described herein, the double eye alarm electronics 200 has a first input terminal 202, a second input terminal 204 and a third input terminal 206. The third output terminal 80 of the input electronics component 70 is in electrical connection with the first input terminal 202 of the double eye alarm electronics 200. The LEMPD going high at the first input terminal 202 simultaneously generates a pulse, called the High Speed Reject Pulse, equal in time duration to $t_{elapsed}$, as discussed above, where $t_{elapsed}$ equals an amount of time between the lead light detector 43 being obstructed and the lag light detector 46 being obstructed for an object traveling $Y_1$ miles per hour. As discussed herein, this allows anomalous inputs, such as might be caused by a flock of birds and obstructions traveling faster than $Y_1$ miles per hour to be ignored by the device 20. Termination of the High Speed Reject Pulse without the lag light detector 46 signaling that it has been blocked, causes a pulse to be generated known as the Window Pulse. The Window Pulse is logically high for a period of time beginning at the termination of the HSR Pulse and ending upon the time elapsing for a hypothetical object traveling $Y_2$ miles per hour would need in order to pass the lead light signal 42 at the moment the HSR Pulse goes high and then reach the lag light signal 45. Any obstruction traveling slower than $Y_2$ miles per hour can therefore be ignored by the device. As soon as the lag light detector 46 is blocked, it generates a conditioned logically high signal (LAMPD) as discussed herein, at both the lag output terminal 78 and the fourth output terminal 82 of the input electronics component 70, the relative logical level of which is shown at point $B_2$ in FIG. 7. The fourth output terminal 82 of the input electronics component 70 is in electrical connection with the second input terminal 204 of the double eye alarm electronics 200. The logically high LAMPD is generated until the lag light source 44 is no longer blocked. Simultaneously with the generation of the LAMPD, a short pulse is generated to eliminate jitter from odd-shaped overheight objects that would otherwise be carried by the LAMPD. This pulse is known as the Anti-Jitter Pulse (AJ Pulse). Both the Window Pulse and the AJ pulse are provided as inputs into a first alarm logic device 180. If the AJ Pulse occurs while the Window Pulse is logically high, a Vehicle Overheight Alarm Pulse is triggered ("DE Pulse"). The DE Pulse triggers the alarm timer 182 which energizes the alarm relay 184 contact closure and activates warning signs and/or audible alarms for the duration set by the alarm timer 182.

Figure 8:
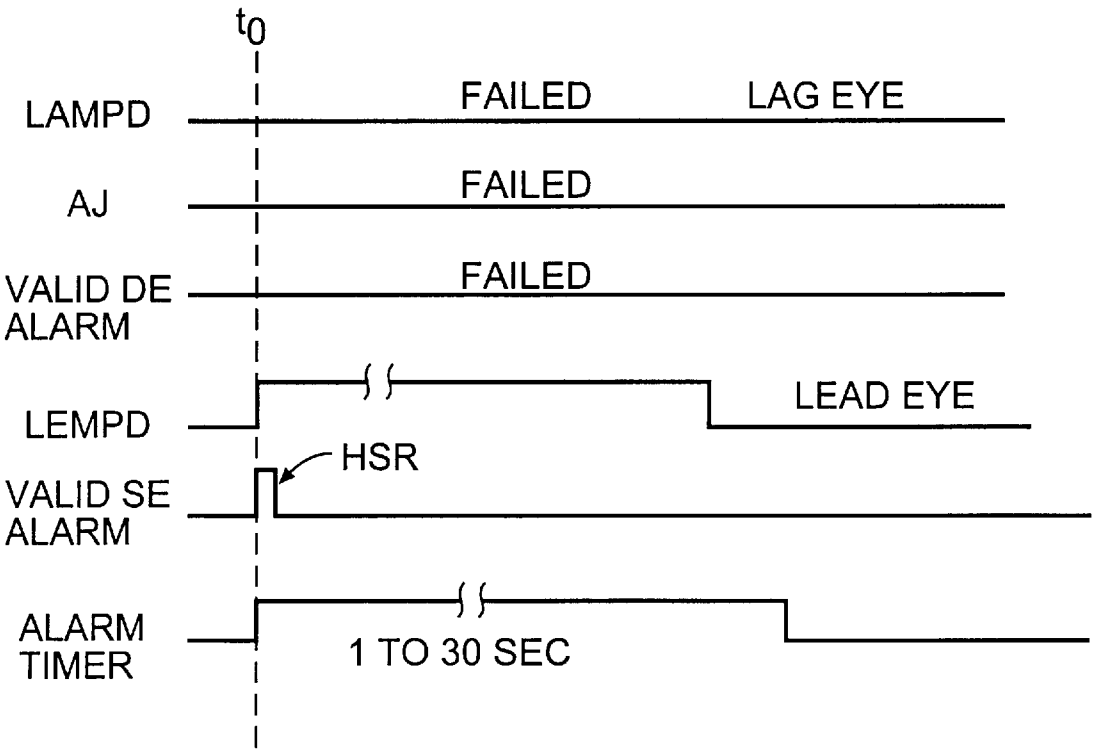
FIG. 8 is a timing diagram for single-source alarm timing at the points indicated in FIG. 6 with the lag detector failed.
Figure 9:
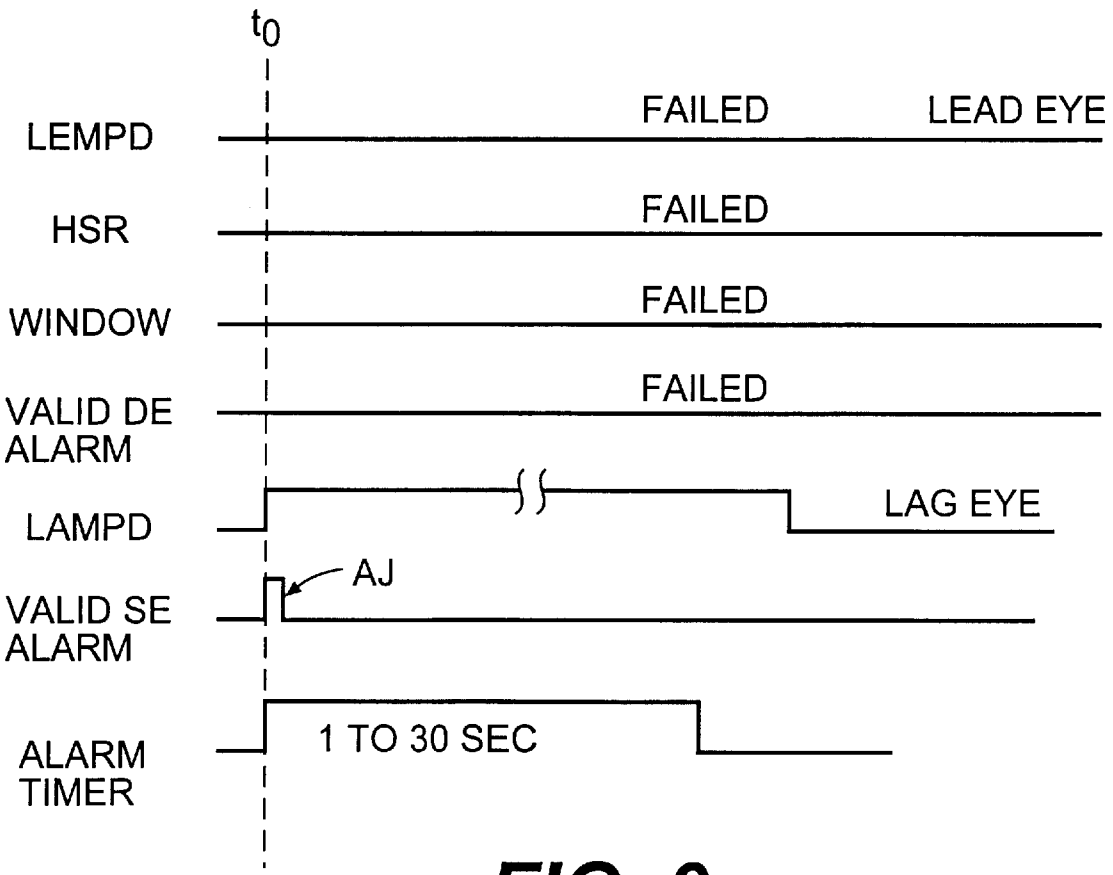
FIG. 9 is a timing diagram for single-source alarm timing at the points indicated in FIG. 6 with the lead detector failed.

If either the lead light source 42 or the lag light source 44 fails (i.e., is blocked or saturated for more than a certain amount of time as discussed herein) the device switches from Double Eye Mode to Single Eye Mode. The component construction and signal processing is virtually identical in either an Event 2 or an Event 3 situation; therefore, only one will be discussed. As for other similar component structures herein, similar components will be denoted with similar numbers followed by the "'" symbol. For an Event 2 situation, refer to FIG. 6 and FIG. 8; for an Event 3 situation, refer to FIG. 6 and 9. Assuming that the lag light source 44 failed and the lead light source 42 was functional, a Lag Alarm Failed signal (LAFAIL) would be generated at the fail output terminal 164' of the fault detection component 100, as shown at point H in FIG. 4. This LAFAIL would be passed to the first alarm logic device 180 via the third input terminal 206 of the double eye alarm electronics 200 and thereby convert the device 20 into Single Eye Mode, inhibiting any DE Alarm Signal. The LAFAIL can also passed to an associated timer/fault relay driver 222 to issue an alarm indicating that the device 20 has switched into Single Eye Mode. In this mode, if an LEMPD is generated by a passing overheight object, the HSR would simultaneously be generated, thereby triggering a Single Eye Alarm Pulse (SE Pulse). The SE Pulse triggers the alarm timer 182 and action thereafter is the same as in Double Eye Mode. As discussed herein, so as to reduce jitter and chatter, as shown at point H in FIG. 4, the LAFAIL signal is terminated, or reduced to a logically low level, following the restoration of the lag eye signal 45 plus twice the triggering time of the second logical device 152 of the fault detection component 100 plus the time at which the timer 160 of the fault detection component 100 is set. Preferably, the triggering time of the second logical device 152 is approximately thirteen seconds (13 s) and the time at which the timer 160 is set is approximately sixty seconds (60 s). Therefore, the LAFAIL signal is preferably terminated approximately eight-six seconds (86 s) following the restoration of the lag eye signal 45.

Figure 10:
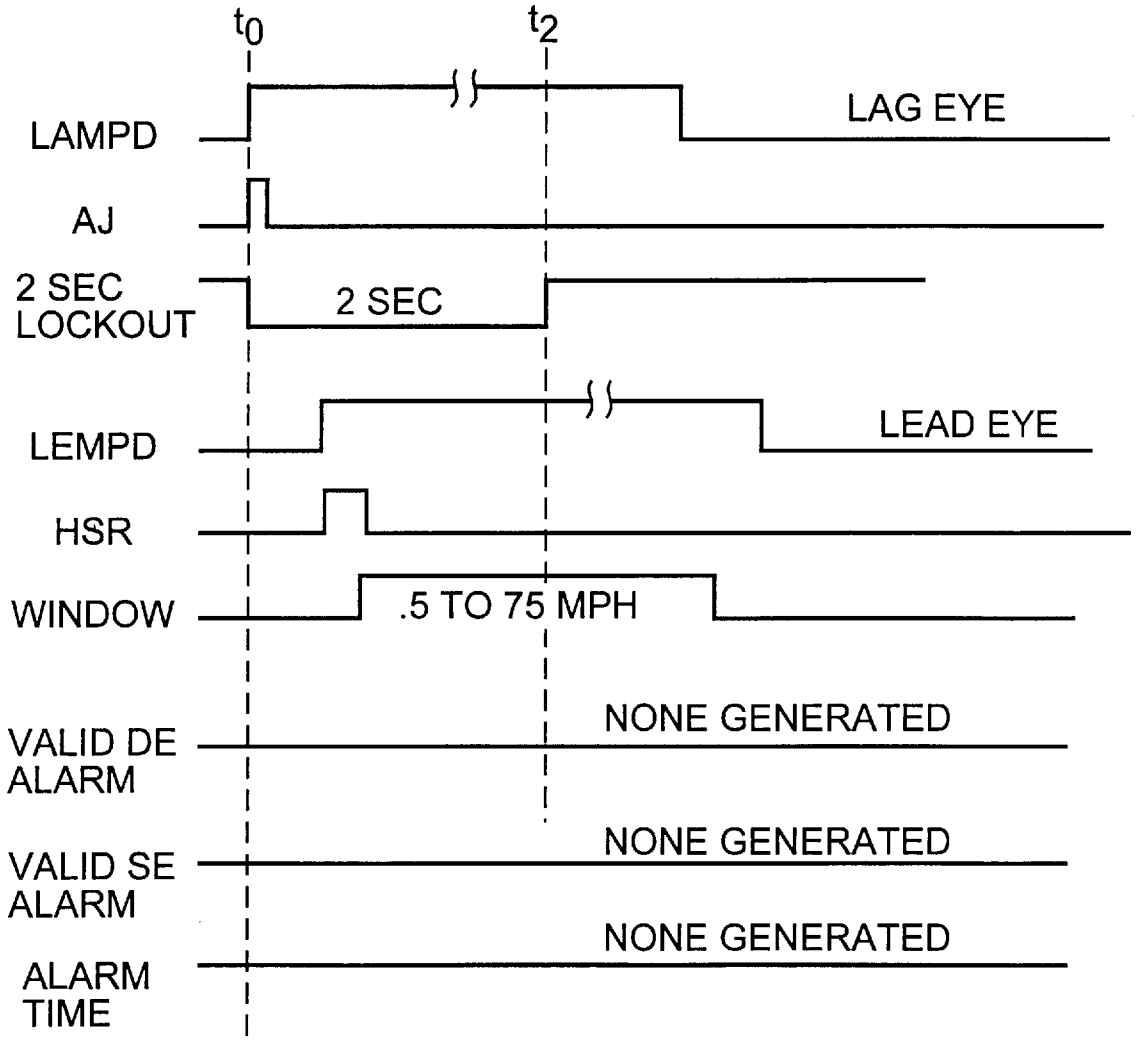
FIG. 10 is a timing diagram for wrong-direction lockout timing of the points indicated in FIG. 6.

Depending on the road contour and access lanes, it is possible for a bouncing, underheight, vehicle or an overheight vehicle to pass the device 20 in the opposite direction of any overheight obstruction. To reduce the possibility of false alarms under these conditions, the device 20 disables itself for a short period of time to reduce the likelihood of such inputs causing erroneous overheight alarms. Therefore, as shown in FIG. 10, if the lag light signal 45 is interrupted before the lead light signal 42, a short lockout timer 230 generates a signal to prevent the propagation of the Window Pulse. The duration of this lockout is about two (2) seconds. A wrong way alarm could also be generated in such a manner.

D. Conclusion

It should be understood that the described embodiments merely illustrate principles of the invention in preferred forms. Many modifications, additions and deletions may be made without departure from the description provided. For example, although the device 20 has been described as linking components via electrical connections, many connections, including the connections between components of the master cabinet 50 and the remote cabinet 30 could be performed by radio or other spectrum-specific electromagnetic communications. Additionally, the device 20 could easily be configured to operate from either or both North American or European standard AC power. Furthermore, the device could be solar powered. It thus is seen that a device and method for detecting vehicle overheight can be made such that anomalous data inputs, particularly environmental anomalies, can be minimized. In addition, this device and method can have a range of applications that is much broader than merely vehicle overheight detection. The device and method act to switch and filter various data while providing certain outputs when objects are detected.

What is claimed is:

1. A dual-beam type photoelectric switching device comprising:

a. a first transmitter for emitting red light in a first direction along a first optical axis, and a first detector placed along the first optical axis, said first detector for receiving red light emitted from the first transmitter and said first detector for outputting a signal indicating the presence and absence of red light emitted from the first transmitter;

b. a second transmitter for emitting infrared light in a second direction along a second optical axis, and a second detector placed along the second optical axis, said second detector for receiving infrared light emitted from the second transmitter and said second detector for outputting a signal indicating the presence and absence of infrared light emitted from the second transmitter; wherein the first optical axis and the second optical axis are approximately parallel to each other and wherein the first direction and the second direction are approximately opposite of each other;

c. a fault detector for receiving the signal from the first light detector and the signal from second light detector, processing said signals and producing outputs indicating fault status of said light detectors; and d. an alarm mode component for receiving the signal of the first detector, the signal of the second detector and the fault status outputs, and for triggering certain outputs in accordance with a predetermined logic.

2. The device of claim 1 wherein the fault detector includes:

a. a first accumulator for measuring a first elapsed time following interruption of normal reception of red light by the first light detector until reestablishment of normal reception of red light by the first light detector;

b. a first comparator for comparing the first elapsed time with a first predetermined value and for outputting a first fault signal related to the first elapsed time exceeding the first predetermined value;

c. a second accumulator for measuring a second elapsed time following interruption of normal reception of infrared light by the second light detector until reestablishment of normal reception of infrared light by the second light detector; and d. a second comparator for comparing the second elapsed time with a second predetermined value and for outputting a second fault signal related to the second elapsed time exceeding the second predetermined value.

3. The device of claim 1 wherein the alarm mode component further comprises:

a. a circuit for:

i. outputting an alarm signal in relation to the alarm mode component receiving the fault status outputs, and ii. enabling and disabling recognition of the signals of the detectors in relation to the fault status outputs; and b. a circuit for comparing the signal of the first detector and the signal of the second detector in accordance with a predetermined logic and outputting a signal.

4. The device of claim 2, wherein:

a. the fault detector further comprises a component for delaying termination of the first fault signal and a component for delaying termination of the second fault signal, for noise reduction;

b. the first accumulator of the fault detector further comprises a component for delaying initiation of measuring of elapsed time and a component for delaying termination of measuring elapsed time, for noise reduction; and c. the second accumulator of the fault detector further comprises a component for delaying initiation of measuring of elapsed time and a component for delaying termination of measuring elapsed time, for noise reduction.

5. The device of claim 4, wherein the component for delaying termination of the first fault signal of the fault detector is a timer and the component for delaying termination of the second fault signal of the fault detector is a timer.

6. The device of claim 4 wherein the component for delaying initiation of measuring of elapsed time of the first accumulator of the fault detector is a first integrating capacitor and the component for delaying termination of measuring elapsed time of the first accumulator of the fault detector is the first integrating capacitor, and the component for delaying initiation of measuring of elapsed time of the second accumulator of the fault detector is a second integrating capacitor and the component for delaying termination of measuring elapsed time of the second accumulator of the fault detector is the second integrating capacitor.

7. The device of claim 6 wherein the first integrating capacitor has a discharge rate twice that of its charge rate, and wherein the second integrating capacitor has a discharge rate twice that of its charge rate.

8. The device of claim 1 for detecting overheight vehicles traveling along a roadway, wherein the first optical axis and the second optical axis define a plane, and the plane and the roadway are substantially parallel to each other, with the shortest distance between the plane and the roadway being substantially equivalent to the maximum vehicle height desired to be measured.

9. A dual-beam type photoelectric switching device for detecting overheight vehicles traveling along a roadway, comprising:

a. a first transmitter for emitting red light in a first direction along a first optical axis, and a first detector placed along the first optical axis, said first detector for receiving red light emitted from the first transmitter and said first detector for outputting a signal indicating the presence and absence of red light emitted from the first transmitter;

b. a second transmitter for emitting infrared light in a second direction along a second optical axis, and a second detector placed along the second optical axis, said second detector for receiving infrared light emitted from the second transmitter and said second detector for outputting a signal indicating the presence and absence of infrared light emitted from the second transmitter; wherein the first optical axis and the second optical axis are approximately parallel to each other and wherein the first direction and the second direction are approximately opposite of each other; wherein the first optical axis and the second optical axis define a plane, and the plane and the roadway are substantially parallel to each other, with the shortest distance between the plane and the roadway being substantially equivalent to the maximum vehicle height desired to be measured;

c. a fault detector for receiving the signal from the first light detector and the signal from second light detector, processing said signals and producing outputs indicating fault status of said light detectors, said fault detector having:

i. a first accumulator for measuring a first elapsed time following interruption of normal reception of red light by the first light detector until reestablishment of normal reception of red light by the first light detector, said first accumulator having a first integrating capacitor for delaying the initiation of measuring elapsed time and for delaying the termination of measuring elapsed time, ii. a first comparator for comparing the first elapsed time with a first predetermined value and for outputting a first fault signal related to the first elapsed time exceeding the first predetermined value, iii. a first timer for delaying termination of first fault signal, iv. a second accumulator for measuring a second elapsed time following interruption of the normal reception of infrared light by the second light detector until reestablishment of normal reception of infrared light by the second light detector, said second accumulator having a second integrating capacitor for delaying the initiation of measuring elapsed time and for delaying the termination of measuring elapsed time, v. a second comparator for comparing the second elapsed time with a second predetermined value and for outputting a second fault signal related to the second elapsed time exceeding the second predetermined value, and vi. a second timer for delaying termination of second fault signal; and d. an alarm mode component for receiving the signal of the first detector, the signal of the second detector and the fault status outputs, and for triggering certain outputs in accordance with a predetermined logic, said alarm mode component having:

i. a circuit for:

(a) outputting an alarm signal in relation to the alarm mode component receiving the fault status outputs, and (b) enabling and disabling recognition of the signals of the detectors in relation to the fault status outputs, ii. a circuit for comparing the signal of the first detector and the signal of the second detector in accordance with a predetermined logic and outputting a signal.

10. A method for detecting an object using a dual-beam type photoelectric switching device comprising the steps of:

a. emitting red light from a first transmitter in a first direction along a first optical axis, receiving red light emitted from the first transmitter by a first detector placed along the first optical axis, and outputting a signal with the first detector to indicate the presence and absence of red light emitted from the first transmitter;

b. emitting infrared light from a second transmitter in a second direction along a second optical axis, receiving infrared light emitted from the second transmitter by a second detector placed along the second optical axis, and outputting a signal with the second detector to indicate the presence and absence of infrared light emitted from the second transmitter; wherein the first optical axis and the second optical axis are approximately parallel to each other and wherein the first direction and the second direction are approximately opposite of each other;

c. receiving the signal from the first light detector and the signal from second light detector with a fault detector, processing said signals and producing outputs indicating fault status of said light detectors; and d. receiving the signal of the first detector, the signal of the second detector and the fault status outputs, and triggering certain outputs in accordance with a predetermined logic.

11. A method for detecting overheight vehicles traveling along a roadway using a dual-beam type photoelectric switching device comprising the steps of:

a. emitting red light from a first transmitter in a first direction along a first optical axis, receiving red light emitted from the first transmitter by a first detector placed along the first optical axis, and outputting a signal with the first detector to indicate the presence and absence of red light emitted from the first transmitter;

b. emitting infrared light from a second transmitter in a second direction along a second optical axis, receiving infrared light emitted from the second transmitter by a second detector placed along the second optical axis, and outputting a signal with the second detector to indicate the presence and absence of infrared light emitted from the second transmitter; wherein the first optical axis and the second optical axis are approximately parallel to each other and wherein the first direction and the second direction are approximately opposite of each other;

c. receiving the signal from the first light detector and the signal from second light detector with a fault detector, processing said signals and producing outputs indicating fault status of said light detectors; said receiving step further comprising the following steps:

i. measuring by use of a first accumulator a first elapsed time following interruption of normal reception of red light by the first light detector until reestablishment of normal reception of red light by the first light detector, said first accumulator having a first integrating capacitor for delaying the initiation of measuring elapsed time and for delaying the termination of measuring elapsed time, ii. comparing the first elapsed time with a first predetermined value and outputting a first fault signal related to the first elapsed time exceeding the first predetermined value, iii. delaying termination of first fault signal for noise reduction, iv. measuring by use of a second accumulator a second elapsed time following interruption of normal reception of infrared light by the second light detector until reestablishment of normal reception of infrared light by the second light detector, said second accumulator having a second integrating capacitor for delaying the initiation of measuring elapsed time and for delaying the termination of measuring elapsed time, v. comparing the second elapsed time with a second predetermined value and outputting a second fault signal related to the second elapsed time exceeding the second predetermined value, and vi. delaying termination of second fault signal for noise reduction; and d. receiving the signal of the first detector, the signal of the second detector and the fault status outputs, with an alarm mode component and triggering certain outputs in accordance with a predetermined logic, the receiving and triggering step having the steps of:

i. outputting an alarm signal in accordance with a predetermined logic related to the alarm mode component receiving the fault status outputs, ii. enabling and disabling recognition of the signals of the detectors in relation to the fault status outputs, and iii. comparing the signal of the first detector and the signal of the second detector in accordance with a predetermined logic and outputting a signal.

* * * * *

UNITED STATES PATENT AND TRADEMARK OFFICE

CERTIFICATE OF CORRECTION

PATENT NO. : 5,828,320
DATED : October 27, 1998
INVENTOR(S) : John H. Buck

It is certified that error appears in the above-identified patent and that said Letters Patent is hereby corrected as shown below:

On the title page, item [75], "Va." should be changed to --VA--.

On the title page, item [73], "Va." should be changed to --VA--.

At column 4, line 36, "Minn." should be changed to --MN--.

At column 4, line 43, "Wash." should be changed to --WA--.

At column 5, line 25, "blocked" should be changed to --blocks--.

At column 9, line 10, "to" should be changed to --$t_0$--.

At column 10, line 16, "X2seconds" should be --$X_2$ seconds--. This error was introduced in the application as originally filed.

At column 10, line 19, "to" should be changed to --$t_0$--.

At column 11, line 41, "the" should be --that--.

At column 11, line 41, "correspond" should be --corresponds--.

At column 14, line 28, --the-- should be inserted before "second".

This error was introduced in the application as originally filed.

UNITED STATES PATENT AND TRADEMARK OFFICE

CERTIFICATE OF CORRECTION

PATENT NO. : 5,828,320
DATED : October 27, 1998
INVENTOR(S) : John H. Buck

It is certified that error appears in the above-identified patent and that said Letters Patent is hereby corrected as shown below:

At column 16, line 5, --the-- should be inserted before "second".

At column 17, line 8, --the-- should be inserted before "second".

At column 17, line 38, --the-- should be inserted before "second".

Signed and Sealed this

Sixth Day of July, 1999

*Attest:*

Q. TODD DICKINSON

*Attesting Officer*

*Acting Commissioner of Patents and Trademarks*